US007607541B2

(12) United States Patent
Girgis et al.

(10) Patent No.: US 7,607,541 B2
(45) Date of Patent: Oct. 27, 2009

(54) LIQUID MEDICATION STORAGE AND DISPENSING UNIT

(76) Inventors: Deborah Girgis, 122 Cannonwood Dr., Glendale, CA (US) 91207; Victoria Lombardi, 2900 Fairway Ave. #408, Glendale, CA (US) 91214

( * ) Notice: Subject to any disclaimer, the term of this patent is extended or adjusted under 35 U.S.C. 154(b) by 284 days.

(21) Appl. No.: 11/585,414

(22) Filed: Oct. 23, 2006

(65) Prior Publication Data

US 2008/0093254 A1 Apr. 24, 2008

(51) Int. Cl.
*B65D 83/04* (2006.01)

(52) U.S. Cl. ..... 206/570; 206/229; 206/438; 206/535

(58) Field of Classification Search ..... 206/229, 206/369, 370, 569–572, 534–536, 538, 528, 206/828; 220/203.04, 203.05, 203.06, 203.09, 220/203.23, 254.1, 254.8, 200, 835–837, 220/839, 916

See application file for complete search history.

(56) References Cited

U.S. PATENT DOCUMENTS

| | | | | |
|---|---|---|---|---|
| 551,424 | A | 12/1895 | Wheeler | |
| 2,613,537 | A | 10/1952 | Addario | |
| 3,128,920 | A | 4/1964 | Volckening et al. | |
| 4,645,079 | A * | 2/1987 | Hill | 206/563 |
| 4,702,737 | A | 10/1987 | Pizzino | |
| 5,007,743 | A | 4/1991 | Brennan | |
| 5,358,117 | A * | 10/1994 | Adams | 206/534 |
| 5,566,828 | A * | 10/1996 | Claes et al. | 206/570 |
| 5,646,912 | A | 7/1997 | Cousin | |
| 5,669,503 | A * | 9/1997 | Robin | 206/528 |
| 5,722,553 | A * | 3/1998 | Hovatter | 220/23.8 |
| 5,850,919 | A * | 12/1998 | Freed | 206/534 |
| 5,894,925 | A * | 4/1999 | Sukiennik et al. | 206/356 |
| 6,021,902 | A * | 2/2000 | Wu | 206/534 |
| 6,126,642 | A | 10/2000 | Kriesel et al. | |
| 6,558,358 | B2 | 5/2003 | Rosoff et al. | |
| 6,601,725 | B2 * | 8/2003 | Lafond et al. | 220/23.4 |
| 6,860,390 | B2 * | 3/2005 | Bowman | 206/534 |
| 2004/0024372 | A1 | 2/2004 | Grogan | |
| 2004/0182873 | A1 | 9/2004 | Baum | |
| 2004/0251165 | A1 | 12/2004 | Girzaitis | |

* cited by examiner

*Primary Examiner*—Ehud Gartenberg
*Assistant Examiner*—Robert Poon
(74) *Attorney, Agent, or Firm*—Cislo & Thomas, LLP

(57) ABSTRACT

A portable liquid medication storage and dispensing unit includes a main container body with associated first and second lids. The first lid encloses a medicine dropper which is removably coupled to an outside wall of the main container body. The second lid provides access to the interior of the main container body. A plurality of stacked vials is introduced into the main container body when the second lid is open. Each of the stacked vials is filled with a pre-measured dosage of liquid medication and configured to allow the pre-setting of time for the user to take a particular medication dose. The vials may be secured and stacked within the main container body in a non-square or square matrix configuration.

40 Claims, 6 Drawing Sheets

LIQUID MEDICATION STORAGE AND DISPENSING UNIT

COPYRIGHT NOTICE

Portions of the disclosure of this patent document may contain material that is subject to copyright and/or mask work protection. The copyright and/or mask work owner has no objection to the facsimile reproduction by anyone of the patent document or the patent disclosure, as it appears in the U.S. Patent and Trademark Office patent file or records, but otherwise reserves all copyright and/or mask work rights whatsoever.

BACKGROUND

Medication recipients frequently need to take a set dose of liquid medication at regular intervals of time. Failure to take the required medication dosage at required time intervals interferes with the prescribed treatment regimen. Liquid medication dosages are typically measured by pouring the medication into a small container via a medicine dropper prior to taking the medication. This manner of on-the-spot dosage measurement is inconvenient and prone to error. Patients who take numerous medications on a regular basis can easily loose track of the time of day or night at which a particular medication was most recently taken. The end result may be an omission by the patient to take the required dosage or exceeding the dosage requirement.

The same problems are being faced by parents or caregivers of children of young age. Frequently, oral antibiotic has to be carried around all day as parents or caregivers go through their daily routine with the child. It would be desirable to have a pre-measured and organized set of liquid medication vials which can be easily transported without compromising the prescribed medication regimen.

Some patients may require a large number of medications in order to maintain a certain degree of health. Administering the dosage level and dosage scheduling of medication may be difficult at best and at worst can lead to unforeseen and undesirable consequences. It would be beneficial to individuals charged with the responsibility of organizing and dispensing liquid medications to these patients to have a liquid medication organizer which would allow the administration and storage of such medications in a safe and reliable manner. Since liquid medications must often be given at different times of the day, it would be desirable to have a liquid medication storage and dispensing unit which allows an individual to organize one to four medication administrations per day for five to seven days in a week.

SUMMARY

Some embodiments disclosed herein are generally directed to a liquid medication storage and dispensing unit.

In accordance with one aspect of the present invention, the liquid medication storage and dispensing unit includes a main container body, a first lid pivotally coupled at one end to the main container body, and a second lid. The second lid is pivotally coupled at one end to the main container body and disposed substantially opposite the first lid. Each of the first and second lids is adapted to rotate relative to the main container body between an open state and a closed state. The unit also includes at least one medicine dropper removably coupled to the main container body. The coupled medicine dropper is enclosed by the first lid when the first lid is in a closed state. The unit further includes a plurality of stacked vials that are introduced into the main container body when the second lid is in an open state. Each of the stacked vials is filled with a pre-measured dosage of liquid medication and configured to allow the pre-setting of time to take a particular medication dose. The vials are secured and stacked within the main container body in a non-square matrix configuration.

In accordance with another aspect of the present invention, the liquid medication storage and dispensing unit includes a main container body, a first lid pivotally coupled at one end to the main container body, and a second lid. The second lid is pivotally coupled at one end to the main container body and disposed substantially opposite the first lid. Each of the first and second lids is adapted to rotate relative to the main container body between an open state and a closed state. The unit also includes at least one medicine dropper removably coupled to the main container body. The coupled medicine dropper is enclosed by the first lid when the first lid is in a closed state. The unit further includes a plurality of stacked vials that are introduced into the main container body when the second lid is in an open state. Each of the stacked vials is filled with a pre-measured dosage of liquid medication and configured to allow the pre-setting of time to take a particular medication dose. The vials are secured and stacked within the main container body in a square matrix configuration.

In accordance with still another aspect of the present invention, the liquid medication storage and dispensing unit includes a main container body and a lid pivotally coupled at one end to the main container body. The lid has a hollow interior and is adapted to rotate relative to the main container body between an open state and a closed state. The unit also includes at least one medicine dropper removably coupled within the hollow lid, and a plurality of securely coupled vials: The vials are introduced into the main container body when the lid is in an open state. Each of the securely coupled vials is filled with a pre-measured dosage of liquid medication and configured to allow the pre-setting of time to take a particular medication dose. The securely coupled vials are disposed within the main container body in a row vector configuration.

These and other aspects of the invention will become apparent from a review of the accompanying drawings and the following detailed description of the invention.

BRIEF DESCRIPTION OF THE DRAWINGS

The present invention is generally shown by way of reference to the accompanying drawings in which.

DETAILED DESCRIPTION

The detailed description set forth below in connection with the appended drawings is intended as a description of illustrated exemplary embodiments and is not intended to represent the only forms in which these embodiments may be constructed and/or utilized. The description sets forth the functions and sequence of steps for constructing and operating the present invention in connection with the illustrated embodiments. However, it is to be understood that the same or equivalent functions and/or sequences may be accomplished by different embodiments that are also intended to be encompassed within the spirit and scope of the present invention.

Some embodiments of the present invention will be described in detail with reference to a liquid medication storage and dispensing unit, as generally shown in FIGS. 1-10. Additional embodiments, features and/or advantages of the invention will become apparent from the ensuing description or may be learned by practicing the invention. In the attached figures, the various drawings are not to scale with like numerals referring to like features throughout both the drawings and the description.

Figure 1:
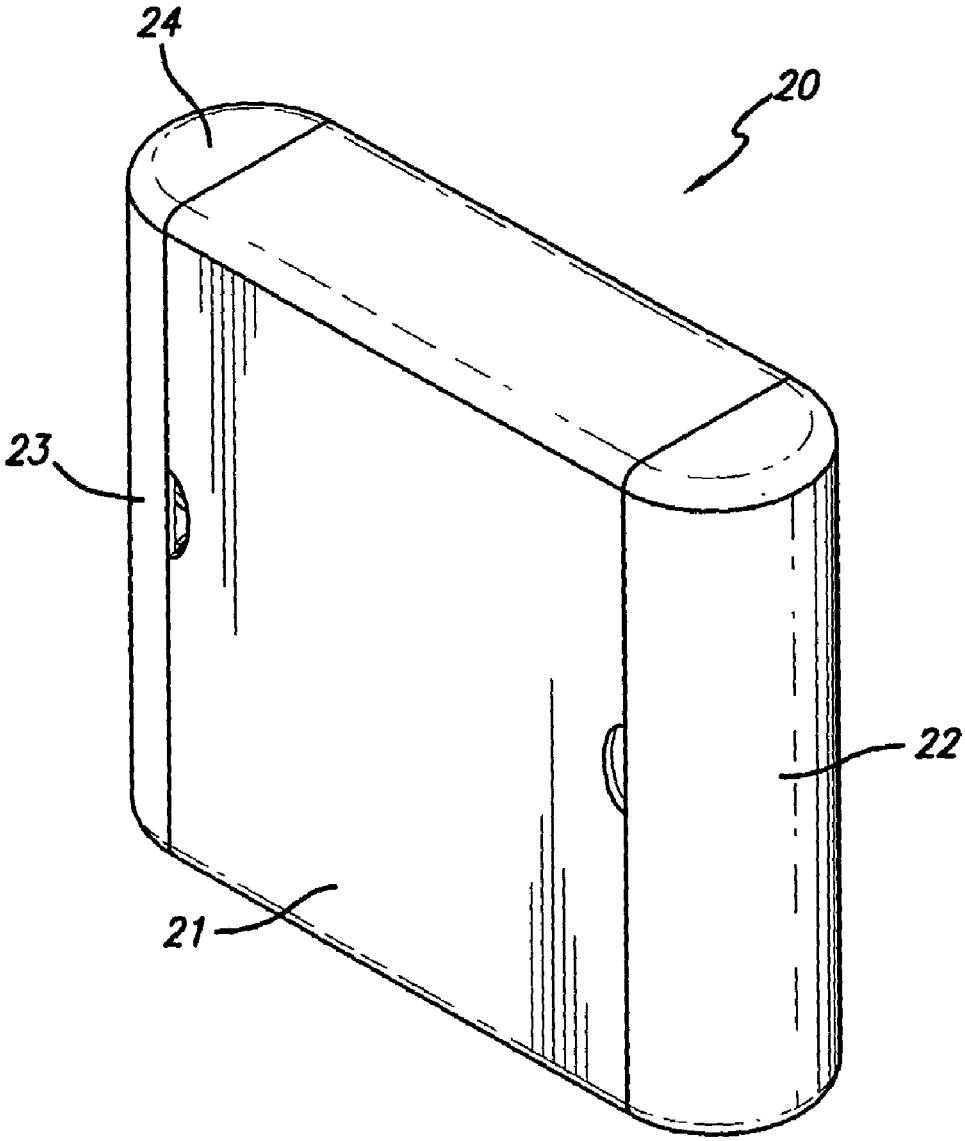
FIG. 1 is a front perspective view of a liquid medication storage and dispensing unit in accordance with an exemplary embodiment of the present invention.
Figure 3:
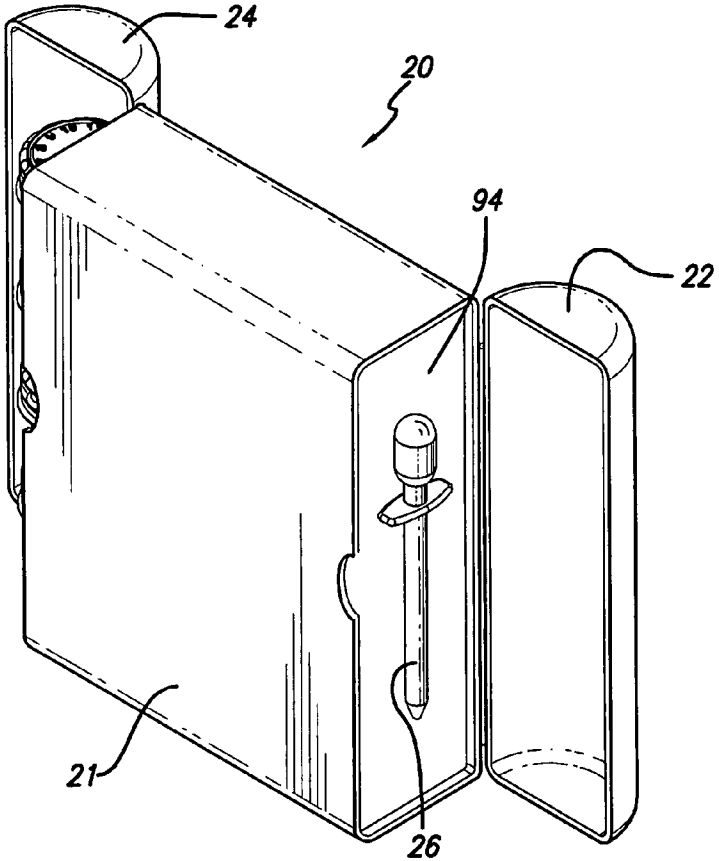
FIG. 3 is a second lateral perspective view of the liquid medication storage and dispensing unit of FIG. 1.
Figure 2:
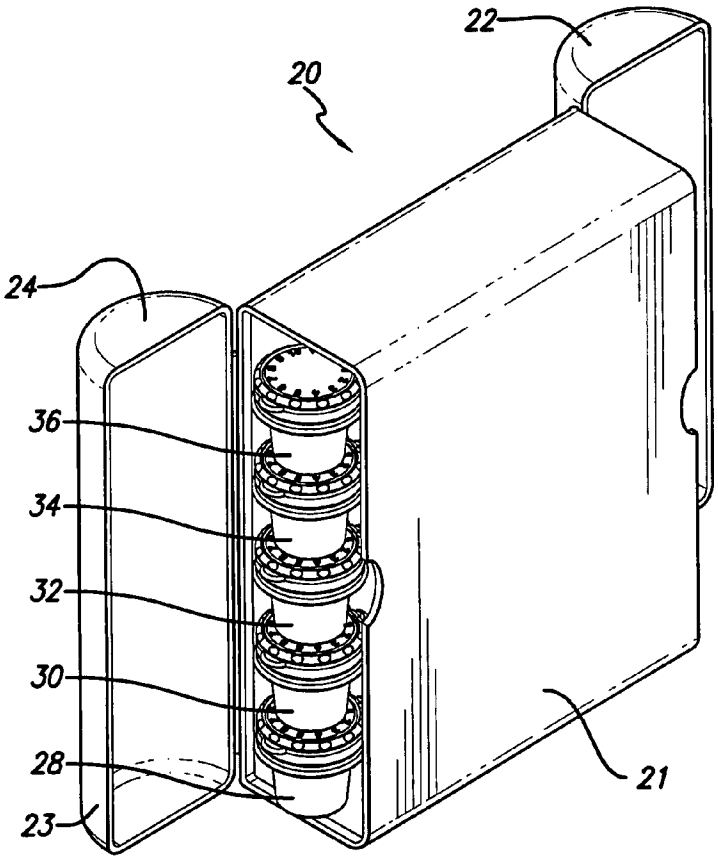
FIG. 2 is a first lateral perspective view of the liquid medication storage and dispensing unit of FIG. 1.
Figure 5:
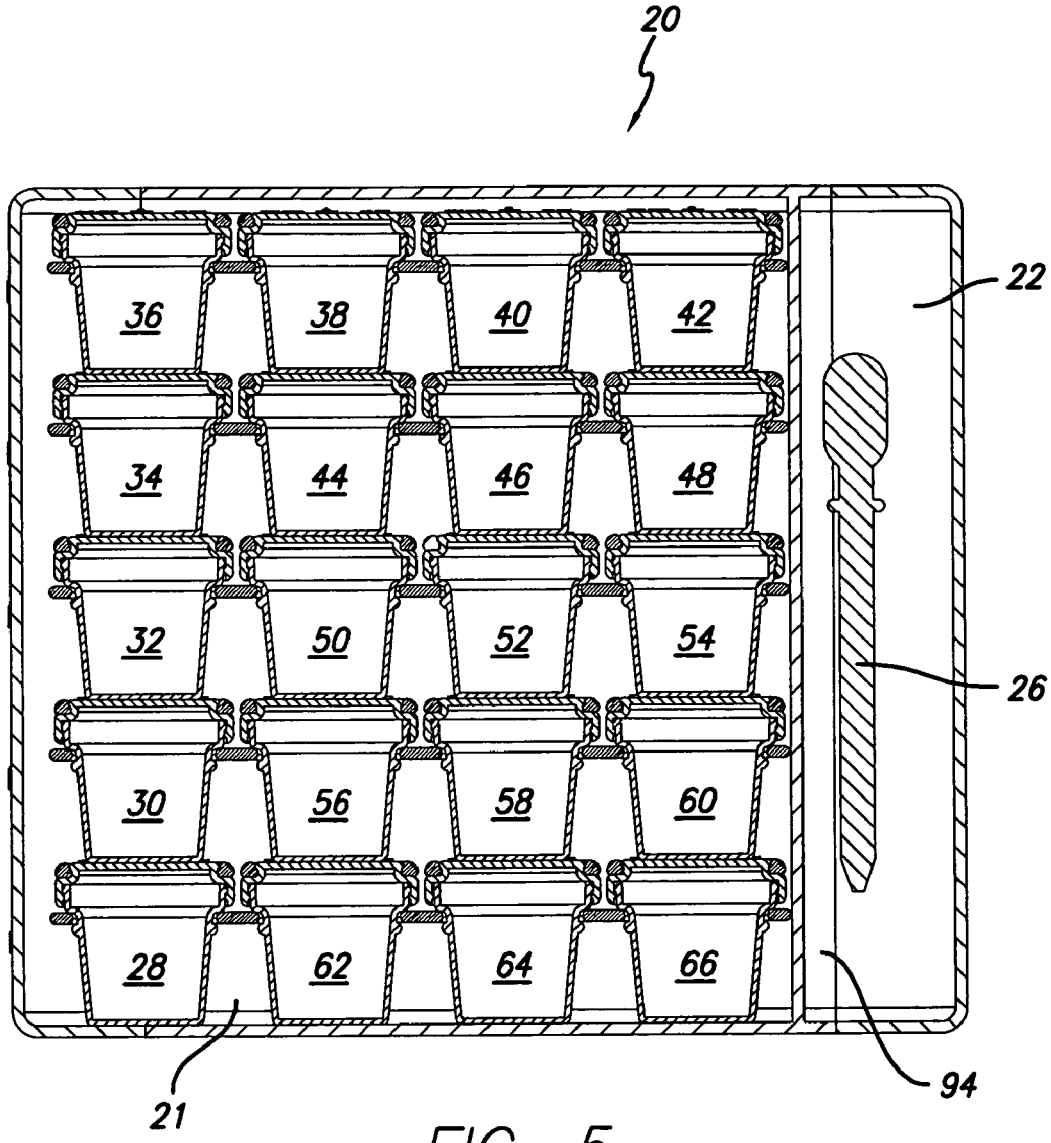
FIG. 5 is a cross-sectional view along section line 5-5 of FIG. 4.

FIG. 1 is a front perspective view of a liquid medication storage and dispensing unit 20 in accordance with an exemplary embodiment of the present invention. Liquid medication storage and dispensing unit 20 includes a main container body 21 which is of a generally rectangular cross section (FIG. 5). Unit 20 is provided with right and left side lids 22, 24, respectively, with each lid being hinged at one end to main container body 21, as generally depicted in reference to FIGS. 2-3. Each lid (22, 24) has a generally semi-circular cross section (FIGS. 2-3). Right side lid 22 is adapted to accommodate a medicine dropper 26 (FIG. 3) when closed. Medicine dropper 26 may be removably coupled to an outer wall of main container body 21, as generally depicted in reference to FIGS. 3, 5. Left side lid 24 is adapted to accommodate partially protruding liquid medication vials 28, 30, 32, 34 and 36 (FIG. 2) when closed.

Main container body 21 is configured to store a plurality of stacked vials with each vial being filled with pre-measured dosage of liquid medication. In one exemplary embodiment, main container body 21 may store a five-say supply of pre-measured liquid medication with the medication being administered four times a day. In this regard, FIG. 5 depicts five rows of liquid medication vials stacked on top of each other forming four columns, i.e. similar to a 5×4 matrix configuration. Each row includes four vials of liquid medication with the medication in each vial being pre-set (measured) for a single administration dose.

For example, on Day 1 (FIG. 4) a patient is supposed to take a certain prescribed liquid medication four times a day using vials 36, 38, 40 and 42 (FIG. 5) and utilizing medicine dropper 26 (FIGS. 3, 5). On Day 2 (FIG. 4) the patient will take the prescribed liquid medication four times a day using vials 34, 44, 46 and 48 (FIG. 5) and utilizing medicine dropper 26 (FIGS. 3, 5). Similarly, on Day 3 (FIG. 4) the patient will take the prescribed liquid medication four times a day using vials 32, 50, 52 and 54 (FIG. 5) and utilizing medicine dropper 26 (FIGS. 3, 5). On Day 4 (FIG. 4) the patient will again take the prescribed liquid medication four times a day using vials 30, 56, 58 and 60 (FIG. 5) and utilizing medicine dropper 26 (FIGS. 3, 5). Finally, on Day 5 (FIG. 4) the patient will take the prescribed liquid medication four times a day using vials 28, 62, 64 and 66 (FIG. 5) and utilizing medicine dropper 26 (FIGS. 3, 5). The Day 1, Day 2, Day 3, Day 4 and Day 5 designations (FIG. 4) may be etched, printed or otherwise indicated on curved outer wall 23 (FIGS. 1-2) of left side lid 24 for easy reference, as needed.

Figure 7:
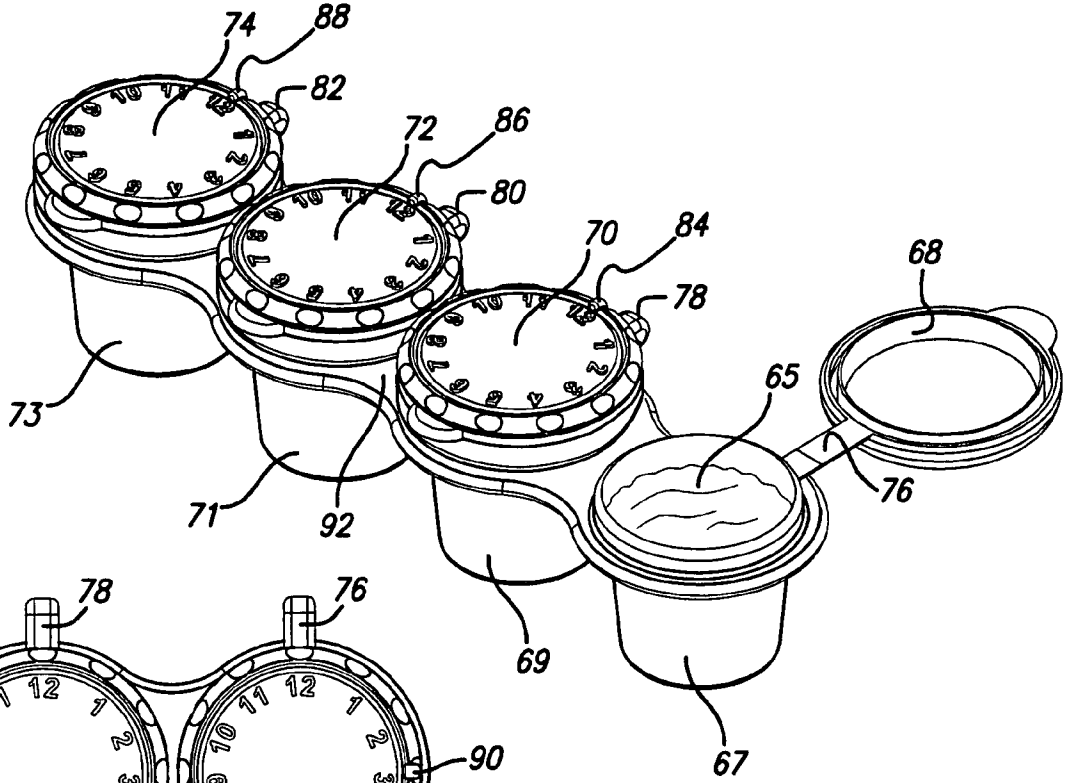
FIG. 7 is a top perspective view of liquid medication vials coupled in accordance with yet another exemplary embodiment of the present invention with one vial being open to reveal liquid medication contained therein.

Each vial may be pre-filled by the user (or the parent/guardian of the user when the user is a minor) with prescription liquid medication from a medication bottle/jar purchased from a pharmacy. Each vial may be provided with a removable snap-on lid which is hinged at one end to the body of the vial as shown, for example in reference to FIG. 7. Particularly, liquid medication vials 67, 69, 71 and 73 are provided with removable lids 68, 70, 72 and 74, respectively. Lids 68, 70, 72 and 74 are coupled to respective outer vial walls via flexible hinges 76, 78, 80 and 82, respectively. FIG. 7 depicts vial 67 with lid 68 being open to reveal liquid medication 65 contained therein.

Each of lids 68, 70, 72 and 74 is provided with a clock-like face which shows the hours in a 12-hour period (FIG. 7). The numbers that represent the hours may be printed, engraved or the like on a lid face for easy identification by the user. A lid face may also be provided with raised lettering, numbering and/or Braille markings, as needed.

A movable hour indicator may be integrally included with each lid face. For example, each of hour indicators 84, 86, 88 (FIG. 7) and 90 (FIG. 8) may be moved by the user or parent/guardian of the user to a particular hour on lid faces 70, 72, 74 and 68 (FIG. 8), respectively, to pre-set a particular time of the day or night when the user will be required to take the liquid medication dose stored in each vial.

Figure 8:
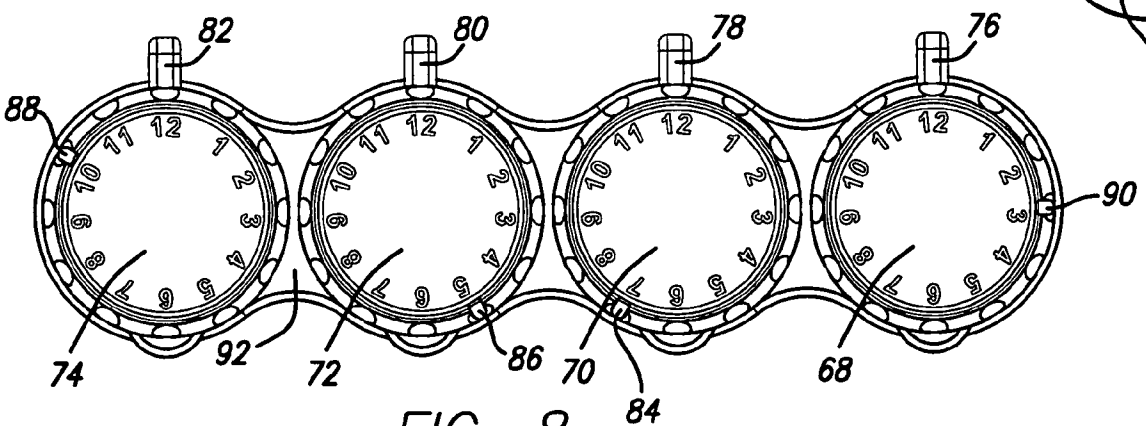
FIG. 8 is a top side plan view of the coupled liquid medication vials of FIG. 7 with all vials being in a closed state and pre-set to different times of the day/night.

A series of vials (filled with a pre-set amount of liquid medicine) may be secured in place via an appropriately apertured carrier strip, such as flexible carrier strip 92 (FIGS. 7-8). In this case, each of vials 67, 69, 71 and 73 is inserted into a respective aperture on carrier strip 92. The inserted vial may be snapped into place generally below the level of the closed lid (FIGS. 7-8). Carrier strip 92 may be configured to hold more or less than the four vials shown in FIGS. 7-8, as needed. Once all liquid medication vials are secured in place via respective flexible carrier strips, the vial sets are stacked on top of each other within main container body 21 (FIG. 3) for storage, as generally shown in reference to FIGS. 2 and 5.

The vial sets may be inserted one by one into main container body 21 when left side lid 24 is fully open. Medicine dropper 26 may be conveniently secured in place against outer side wall 94 (FIGS. 3, 5) of main container body 21 when right side lid 22 is open. Unit 20 containing the stacked daily dose sets of vials and associated medicine dropper 26 may be stored in a refrigerator and used, as needed. The walls of main container body 21 and/or side lids 22 and 24 may be thermally insulated, as needed.

Other configurations may be utilized to secure in place a series of vials filled with pre-measured liquid medication, provided such other configurations do not depart from the intended purpose of the present invention. The vial body, vial lid and carrier strip may be made of plastic and/or other material(s) suitable for practicing the present invention. The main container body with its right and left side lids may also be made of plastic or other suitable materials.

Liquid medication storage and dispensing unit 20 may be made of opaque plastic material, as generally shown in reference to FIGS. 1-4. Alternatively, the unit may be made of transparent plastic material (FIG. 6).

Figure 6:
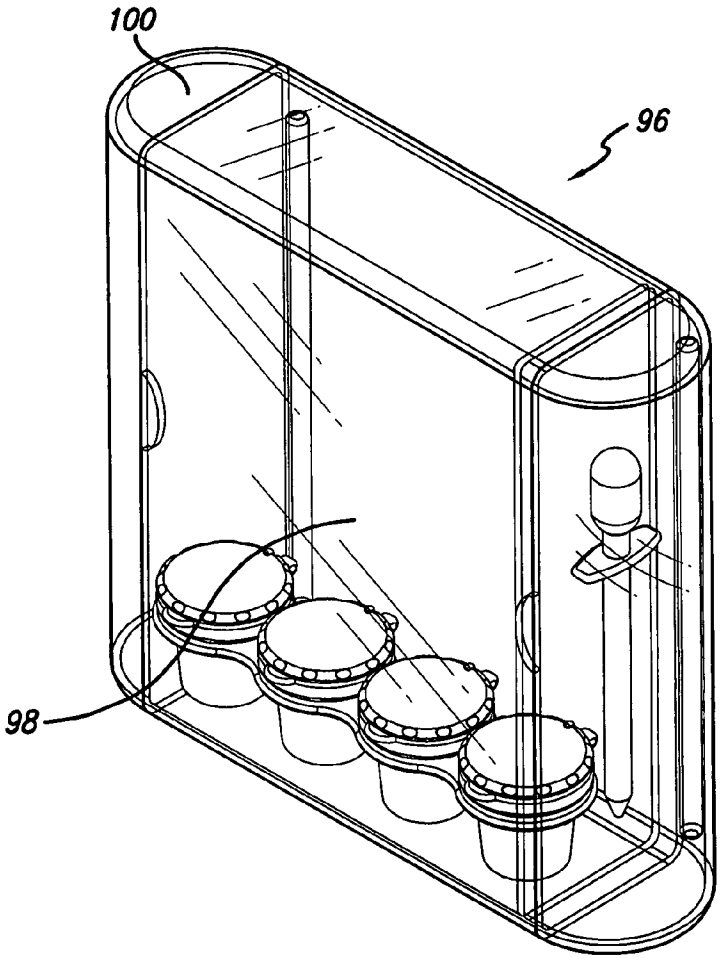
FIG. 6 is a front perspective view of a liquid medication storage and dispensing unit in accordance with another exemplary embodiment of the present invention.
Figure 4:
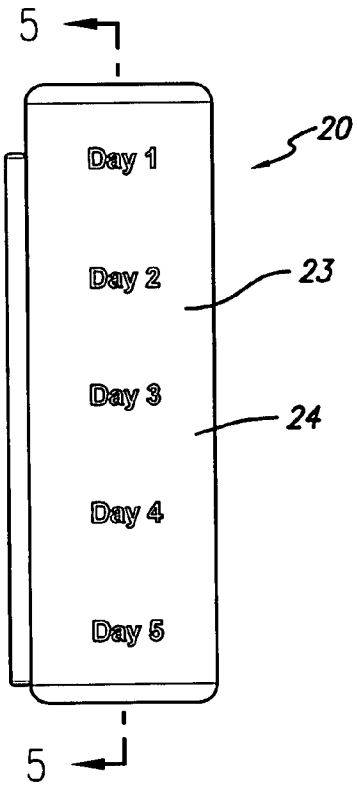
FIG. 4 is a left side plan view of the liquid medication storage and dispensing unit of FIG. 1.

FIG. 6 depicts a generally transparent liquid medication storage and dispensing unit 96 which allows the user to view the contents of main container body 98 from outside, i.e. without opening left side lid 100. Specifically, the user can readily ascertain that only four vials containing pre-measured liquid medication remain inside main container body 98 (FIG. 6) for future use.

Figure 9:
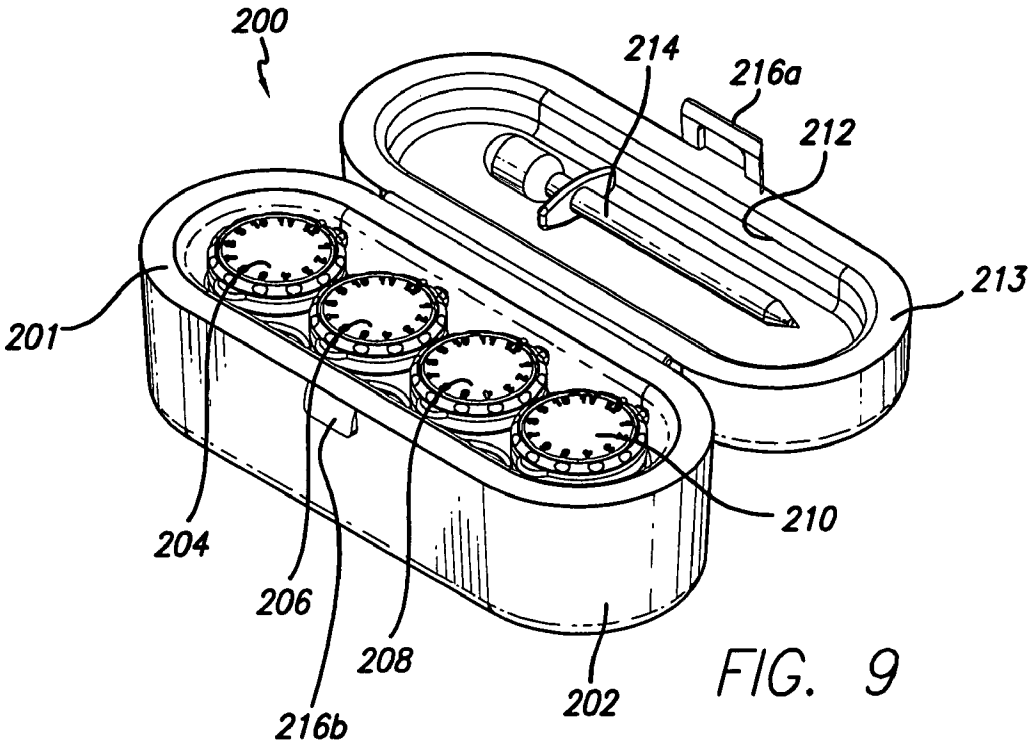
FIG. 9 depicts an open liquid medication storage and dispensing unit constructed in accordance with still another exemplary embodiment of the present invention.

FIG. 9 depicts an open liquid medication storage and dispensing unit 200 constructed for portability in accordance with still another exemplary embodiment of the present invention. Portable liquid medication storage and dispensing unit 200 includes a generally oblong main container body 202 adapted to hold a day supply (four-vial set) of pre-measured liquid medication. The four vials (204, 206, 208 and 210) shown in FIG. 9 are configured and secured in place generally in the same manner as described hereinabove in reference to FIGS. 7-8. Side wall 201 (FIG. 9) of main container body 202 may be thermally insulated—e.g. filled with gel having appropriate thermal insulation characteristics. Bottom wall 203 (FIG. 10) of main container body 202 may also be thermally insulated, as needed.

Figure 10:
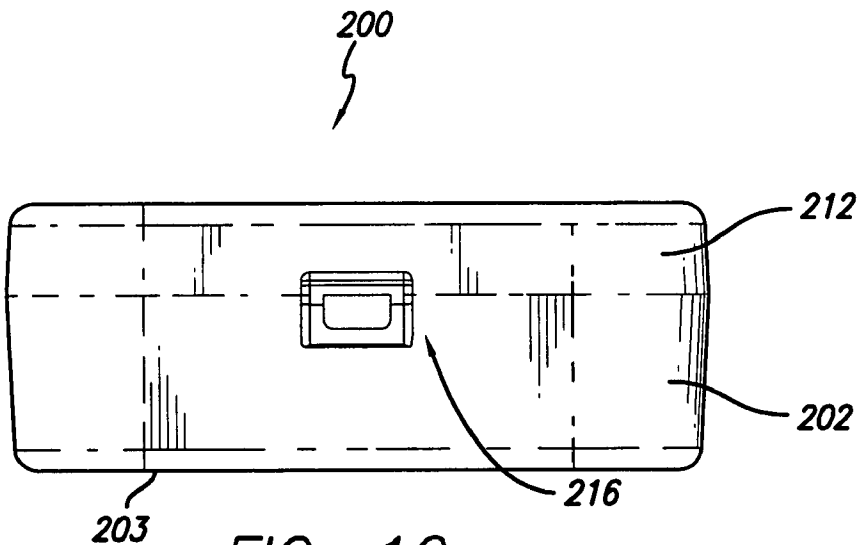
FIG. 10 is a front side plan view of the liquid medication storage and dispensing unit of FIG. 9.

Unit 200 also includes a removable lid 212 which may be hinged at one end to main container body 202 (FIG. 9). Lid 212 conforms to the overall shape of main container body 202 (FIG. 9). Lid 212 is configured to securely store a medicine dropper 214 (FIG. 9). When closed, lid 212 securely snaps onto main container body 202 via latch 216 (FIG. 10). In this regard, FIG. 9 generally depicts latch components 216*a*, 216*b*. Side wall 213 (FIG. 9) of lid 212 may be thermally insulated—e.g. filled with gel having appropriate thermal insulation characteristics.

With liquid medication-filled vials 204, 206, 208 and 210 secured inside main container body 202, unit 200 may be stored in a refrigerator and used conveniently as a day pack whenever needed.

The liquid medication storage and dispensing unit of the present invention makes medication management easier than ever. The main container body and associated lid(s) may be manufactured from material(s) that are easy to clean and maintain. The medication compartment provided by the main container body may be used to store pills and/or liquid medicine in vials, as desired. The vial lids as well as the unit itself may be made child-proof. The liquid medication storage and dispensing unit of the present invention provides a convenient and secure means to organize, store and administer liquid medicine to patients of relatively young age.

The liquid medication-filled vials may be secured and stacked within the main container body of the present invention in a non-square or square matrix configuration. For example, in the embodiment shown in reference to FIGS. 9-10, the four liquid medication-filled vials are secured by a flexible carrier strip and stored within generally oblong main container body 202 in a row vector configuration.

The exemplary embodiments described hereinabove are merely illustrative of the general principles of the present invention. Various design modifications may be employed that would reside within the scope of the invention. Thus, by way of example, but not of limitation, various alternative configurations may be utilized in accordance with the teachings herein. Accordingly, the drawings and description are illustrative and not meant to be a limitation thereof.

Moreover, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Thus, it is intended that the invention cover all embodiments and variations thereof as long as such embodiments and variations come within the scope of the appended claims and their equivalents.

What is claimed:

1. A liquid medication storage and dispensing unit, comprising:

a main container body;

a first lid pivotally coupled at one end to said main container body;

a second lid pivotally coupled at one end to said main container body and disposed substantially opposite said first lid, each of said first and second lids being adapted to rotate relative to said main container body between an open state and a closed state;

at least one medicine dropper removably coupled to said main container body, said coupled medicine dropper being enclosed by said first lid when said first lid is in said closed state; and a plurality of stacked vials in said main container body, each of said stacked vials being filled with a pre-measured dosage of liquid medication and configured to allow the pre-setting of time to take a particular medication dose, said vials being secured and stacked within said main container body in a non-square matrix configuration.

2. A liquid medication storage and dispensing unit, comprising:

a main container body;

a first lid pivotally coupled at one end to said main container body;

a second lid pivotally coupled at one end to said main container body and disposed substantially opposite said first lid, each of said first and second lids being adapted to rotate relative to said main container body between an open state and a closed state;

at least one medicine dropper removably coupled to said main container body, said coupled medicine dropper being enclosed by said first lid when said first lid is in said closed state; and a plurality of stacked vials in said main container body in each of said stacked vials being filled with a pre-measured dosage of liquid medication and configured to allow the pre-setting of time to take a particular medication dose, said vials being secured and stacked within said main container body in a square matrix configuration.

3. A liquid medication storage and dispensing unit, comprising:

a main container body;

a lid pivotally coupled at one end to said main container body, said lid having a hollow interior and being adapted to rotate relative to said main container body between an open state and a closed state;

at least one medicine dropper removably coupled within said hollow lid; and a plurality of securely coupled vials in said main container body, each of said securely coupled vials being filled with a pre-measured dosage of liquid medication and configured to allow the pre-setting of time to take a particular medication dose, said securely coupled vials being disposed within said main container body in a row vector configuration.

4. The liquid medication storage and dispensing unit of claim 1, wherein said main container body has a substantially rectangular cross section.

5. The liquid medication storage and dispensing unit of claim 2, wherein said main container body has a substantially rectangular cross section.

6. The liquid medication storage and dispensing unit of claim 3, wherein said main container body has a substantially oblong configuration.

7. The liquid medication storage and dispensing unit of claim 6, wherein said lid conforms to the overall shape of said main container body.

8. The liquid medication storage and dispensing unit of claim 7, wherein said lid is adapted to securely snap onto said main container body via at least one latch.

9. The liquid medication storage and dispensing unit of claim 3, wherein said lid is thermally insulated.

10. The liquid medication storage and dispensing unit of claim 3, wherein said main container body is thermally insulated.

11. The liquid medication storage and dispensing unit of claim 3, wherein said main container body and said lid are configured for portability use.

12. The liquid medication storage and dispensing unit of claim 1, wherein said first lid has a substantially semi-circular cross section.

13. The liquid medication storage and dispensing unit of claim 1, wherein said second lid has a substantially semi-circular cross section.

14. The liquid medication storage and dispensing unit of claim 2, wherein said first lid has a substantially semi-circular cross section.

15. The liquid medication storage and dispensing unit of claim 2, wherein said second lid has a substantially semi-circular cross section.

16. The liquid medication storage and dispensing unit of claim 1, wherein said at least one medicine dropper is removably coupled to an outer wall of said main container body.

17. The liquid medication storage and dispensing unit of claim 2, wherein said at least one medicine dropper is removably coupled to an outer wall of said main container body.

18. The liquid medication storage and dispensing unit of claim 1, wherein each of said stacked vials includes a pivotally coupled lid.

19. The liquid medication storage and dispensing unit of claim 18, wherein said pivotally coupled vial lid is provided with a clock-like face showing the hours in a 12-hour period.

20. The liquid medication storage and dispensing unit of claim 19, further comprising a movable hour indicator which is integrally included with said clock-like face.

21. The liquid medication storage and dispensing unit of claim 2, wherein each of said stacked vials includes a pivotally coupled lid.

22. The liquid medication storage and dispensing unit of claim 21, wherein said pivotally coupled vial lid is provided with a clock-like face showing the hours in a 12-hour period.

23. The liquid medication storage and dispensing unit of claim 22, further comprising a movable hour indicator which is integrally included with said clock-like face.

24. The liquid medication storage and dispensing unit of claim 3, wherein each of said securely coupled vials includes a pivotally coupled lid.

25. The liquid medication storage and dispensing unit of claim 24, wherein said pivotally coupled vial lid is provided with a clock-like face showing the hours in a 12-hour period.

26. The liquid medication storage and dispensing unit of claim 25, further comprising a movable hour indicator which is integrally included with said clock-like face.

27. The liquid medication storage and dispensing unit of claim 3, wherein said vials are securely coupled via an appropriately apertured carrier strip.

28. The liquid medication storage and dispensing unit of claim 2, wherein at least one set of said vials is secured in a row vector configuration via an appropriately apertured carrier strip.

29. The liquid medication storage and dispensing unit of claim 1, wherein at least one set of said vials is secured in a row vector configuration via an appropriately apertured carrier strip.

30. The liquid medication storage and dispensing unit of claim 29, wherein said apertured carrier strip is made of flexible material.

31. The liquid medication storage and dispensing unit of claim 28, wherein said apertured carrier strip is made of flexible material.

32. The liquid medication storage and dispensing unit of claim 27, wherein said apertured carrier strip is made of flexible material.

33. The liquid medication storage and dispensing unit of claim 1, wherein said main container body is made of opaque material.

34. The liquid medication storage and dispensing unit of claim 1, wherein said main container body is made of transparent material.

35. The liquid medication storage and dispensing unit of claim 2, wherein said main container body is made of opaque material.

36. The liquid medication storage and dispensing unit of claim 2, wherein said main container body is made of transparent material.

37. The liquid medication storage and dispensing unit of claim 1, wherein said main container body and said first and second lids are made of opaque material.

38. The liquid medication storage and dispensing unit of claim 1, wherein said main container body and said first and second lids are made of transparent material.

39. The liquid medication storage and dispensing unit of claim 2, wherein said main container body and said first and second lids are made of opaque material.

40. The liquid medication storage and dispensing unit of claim 2, wherein said main container body and said first and second lids are made of transparent material.

* * * * *